US007363940B2

(12) United States Patent
Oberley et al.

(10) Patent No.: US 7,363,940 B2
(45) Date of Patent: Apr. 29, 2008

(54) FLOW-RATE RESTRICTOR INSERT FOR ORIFICE EXPANSION DEVICE

(75) Inventors: Brian Joseph Oberley, Monroeville, IN (US); Dean J. Groff, Ft. Wayne, IN (US)

(73) Assignee: Parker-Hannifin Corporation, Cleveland, OH (US)

( * ) Notice: Subject to any disclaimer, the term of this patent is extended or adjusted under 35 U.S.C. 154(b) by 513 days.

(21) Appl. No.: 11/075,087

(22) Filed: Mar. 8, 2005

(65) Prior Publication Data

US 2005/0204769 A1 Sep. 22, 2005

Related U.S. Application Data

(60) Provisional application No. 60/554,096, filed on Mar. 18, 2004.

(51) Int. Cl.
*F15D 1/02* (2006.01)
*F25B 41/06* (2006.01)

(52) U.S. Cl. ..... 137/513.3; 137/493.8; 137/493.9; 137/504; 138/44; 138/45; 62/511; 62/527

(58) Field of Classification Search ..... 137/513.3, 137/504, 493.8, 493.9; 138/44, 45; 62/498, 62/511, 527, 324.6
See application file for complete search history.

(56) References Cited

U.S. PATENT DOCUMENTS 4,896,696 A 1/1990 Bradley et al.
5,265,438 A 11/1993 Knowles et al.
5,893,273 A 4/1999 Casiraghi
5,894,741 A 4/1999 Durham et al.
6,363,965 B1 4/2002 Carmack et al.
6,367,283 B1 4/2002 Enderle
6,378,328 B1 * 4/2002 Cholkeri et al. ..... 62/528
6,560,987 B2 5/2003 Kreger et al.

* cited by examiner

*Primary Examiner*—Ramesh Krishnamurthy
(74) *Attorney, Agent, or Firm*—Joseph J. Pophal; Robert J. Clark

(57) ABSTRACT

A generally cylindrical restrictor insert for containing an axially movable, apertured restrictive member, housed in a flow control distributor housing of an orifice expansion device used for bi-directionally-flowing pressurized fluid, with a housing passageway being closed off via an annular adaptor flange also having an internal filter, the restrictor insert having a central axial through bore with a plurality of adjoining bore portions defining a central bore cavity, the restrictor insert also having a leading portion, with a frusto-conical front end surface, and intermediate and trailing portions, the latter having a shoulder portion and an annular end face, the restrictive member being located and axially freely movable within a distributor housing central bore cavity, with the restrictor insert, in turn being located, via slip-fit insertion, in a distributor housing central passageway. The use of a restrictor insert permits interchangeable use of differing restrictive members within a common distributor housing.

20 Claims, 2 Drawing Sheets

FLOW-RATE RESTRICTOR INSERT FOR ORIFICE EXPANSION DEVICE

CROSS-REFERENCE TO RELATED CASES

The present application claims the benefit of the filing date of U.S. Provisional Application Ser. No. 60/554,096, filed Mar. 18, 2004, the disclosure of which is incorporated herein by reference.

BACKGROUND OF THE INVENTION

Orifice piston expansion devices are utilized for metering the flow of pressurized fluid, such as refrigerant medium, along two or more fluid flow paths within a refrigeration or cooling system, such as between the condenser and evaporator coils of a heat pump or other such devices that include a reversible refrigeration cycle. More particularly, existing restrictive members, such as various types of pistons are used, within flow control distributor housings, to perform the required metering and bypass functions, which are well known in the art. Such existing expansion devices and pistons are shown and described, in U.S. Pat. No. 4,896,696, to Bradley et al. and in even more detail in U.S. Pat. No. 5,894,741 to Durham et al., which is also assigned to the assignee of the present invention. Such prior art flow control distributor housings were designed to generally receive only one style of such restrictive members or pistons.

In addition to the above-noted references, the patent literature includes a large number of orifice expansion devices or the like and included in this art are: U.S. Pat. No. 5,265,438 to Knowles et al.; U.S. Pat. No. 5,893,273 to Casiraghi; U.S. Pat. No. 6,363,965 B1 to Carmack et al.; U.S. Pat. No. 6,367,283 B1 to Ederle; and U.S. Pat. No. 6,560,987 B2 to Kreger et al. While the noted Kreger et al. patent discloses a cartridge for a restrictor, this cartridge only provides a seat for a bullet nose type of restrictor and will not accommodate the remaining piston styles. In addition, and importantly so, the cartridge is subsequently brazed in place and, consequently, not replaceable. It is deemed that none of the prior art structures, set forth in the noted references, pertain to the orifice expansion device, the improved orifice expansion device and the restrictor insert, of the present invention.

FIELD OF THE INVENTION

The present invention pertains to orifice expansion devices used in, for example in refrigeration and cooling systems, for conveying bi-directionally movable pressurized fluid. Specifically, this invention pertains to a cylindrical restrictor insert that permits the interchangeable use of differing restrictive members within a common distributor housing.

DETAILED DESCRIPTION OF THE INVENTION

Figure 1:
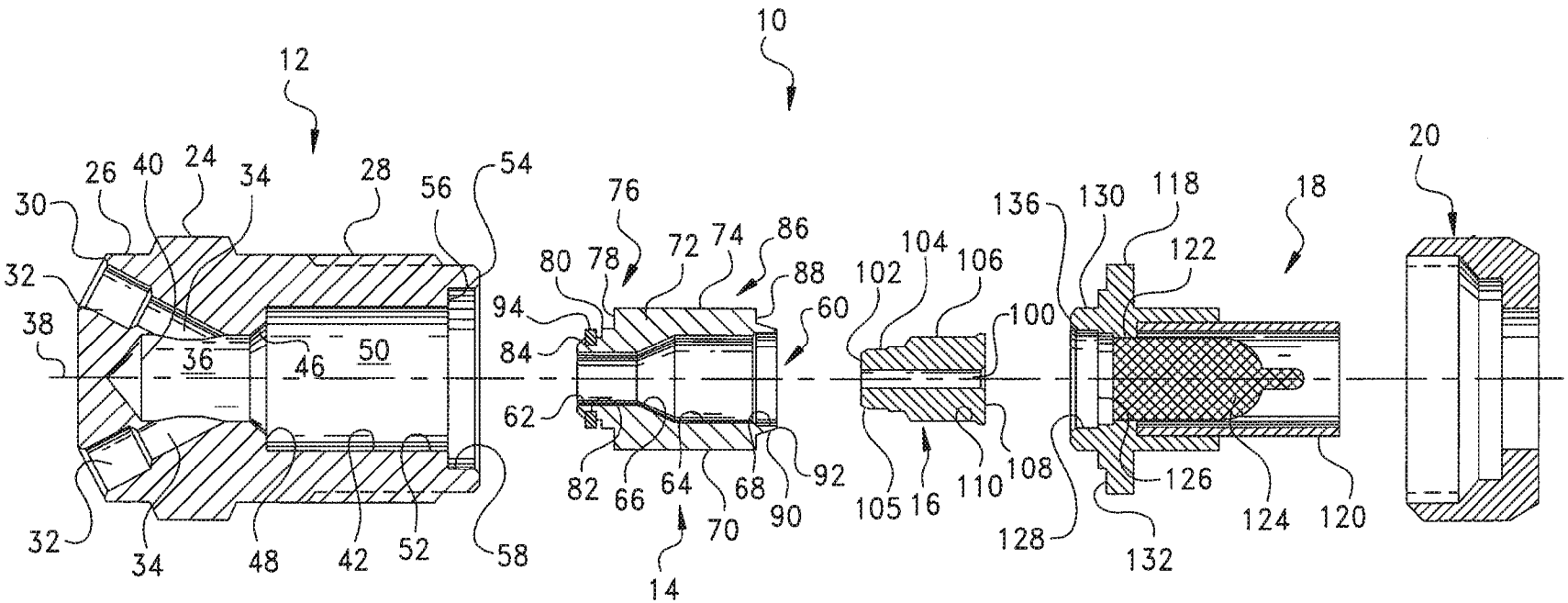
FIG. 1 is an exploded sectional view of an orifice piston expansion device that utilizes the restrictor insert of the present invention.

Referring now to the several drawings, illustrated in FIG. 1, in an exploded view, is an orifice expansion device, generally indicated at 10, that utilizes the restrictor insert 14 of the present invention. Expansion device 10 is basically comprised of a flow control distributor housing 12, the restrictor insert 14, a restrictor or piston 16, an adaptor 18 and a fastening member 20. Since the basic structure, mode of operation and function of expansion device 10 are well known in the art, in the interest of brevity, only those portions thereof that are necessary for a complete understanding of this invention will be described in detail hereinafter. Each of the noted components, except for restrictor insert 14, is known in the art and explained in greater detail in previously cited U.S. Pat. No. 5,894,741, to Durham et al.

Flow control distributor housing 12, which is of a generally cylindrical shape and which may be configured to include an intermediate hexagonal flats section 24, for engagement with wrench or the like, also includes a forward distributor end 26 and a rearward coupling end 28. Forward distributor end 26 is structured to terminate in an angled nozzle face 30, while rearward end 28 is externally threaded for connection to adaptor 18. Nozzle face 30 is provided with at least a single port opening 32 for admitting refrigerant medium flow through device 10. Housing 12 further includes a central fluid passageway 36 extending along a central longitudinal axis 38, from a forward passageway end 40 to an open rear passageway end 42. Forward passageway 40 is coupled in fluid communication with each of port openings 32 via individual associated ducts 34.

For effecting a fluid tight seal with restrictor insert 14, an annular frusto-conical valve seat 46 merges into passageway 36, intermediate forward and rear ends 40 and 42, respectively. The small diameter end of valve seat 46 merges into passageway 36 while the large diameter end thereof merges into an annular shoulder 48 which also forms the inner end of a chamber 50 having a cylindrical outer surface 52. Rearward coupling end 28 includes an annular end face 54 having a step portion 56, the small diameter end of which normally intersects open rear passageway end 42.

Turning now to restrictor insert 14, which is of generally cylindrical shape, includes a central, longitudinal, through bore 60 comprised of a cylindrical front or first bore portion 62, of a predetermined first diameter bore, coupled to a cylindrical intermediate or second bore portion 64, of a predetermined second diameter bore, via a frusto-conical joinder bore portion 66, and a cylindrical rear or third bore portion 68, of a third predetermined diameter bore. Restrictor insert 14 also includes a cylindrical central portion 72, having a cylindrical outer peripheral surface 74, a leading or front portion 76 having multiple annular steps 78, 80, as well as a leading frusto-conical front end surface 84, separated from step 80 via a peripheral groove 82 which serves to locate a seal member 94 preferably comprised of a PTFE material or the like. Restrictor insert 14 additionally includes a trailing or rear portion 86 having an annular outer shoulder step or surface portion 88 that is joined to an annular end surface 92 via an intermediate conical portion 90. The trailing end of inner cylindrical surface 52 of chamber 50 forms the inner diameter portion of annular end surface 92.

Continuing now with restrictive member, restrictor, or piston 16, which is shown for illustrative purposes only, is generally cylindrical in shape and is provided with a central, longitudinal through bore 100. Typical piston 16 includes an annular front end portion 102 that includes a frusto-conical or curved front end surface 104, with a radius 105, the former, in turn, merging into a cylindrical rear portion 106 having an annular rear end portion or surface 108. A typical prior art restrictor or piston of this type, referred to in the industry as a "bullet-nose" piston, is shown and described in U.S. Pat. No. 4,896,696 to Bradley et al. If desired, the cylindrical peripheral outer surface 110 of rear portion 106 can also be provided with a plurality of axially aligned flutes or channels (not shown) in a manner well known in the art and shown and described in previously noted U.S. Pat. No. 5,894,741 to Durham et al.

Turning now to adaptor 18, it is conventionally provided with a forward flange end 118, over which is received the known internally threaded nut or other conventional fastening member 20, for a threaded connection with coupling end 28 of flow control distributor housing 12, and a rearward tubular end 120, which is generally configured (not shown) for a brazed, soldered, sweat or other connection with a further tube, conduit or other refrigerant medium supply line in a manner well known in the art. Mounted within adaptor 18, at a peripheral inner cylindrical surface 122 of flange end 118, is a screen or other in-line filter member 124 adapted for separating particulate contaminants from the refrigerant medium flow. As will be discussed in more detail later, screen annular end face 126 serves as an abutment surface for piston annular end portion 108, when piston 16 is in the FIG. 3 free-flow direction of the refrigerant medium within orifice expansion device 10.

Figure 2:
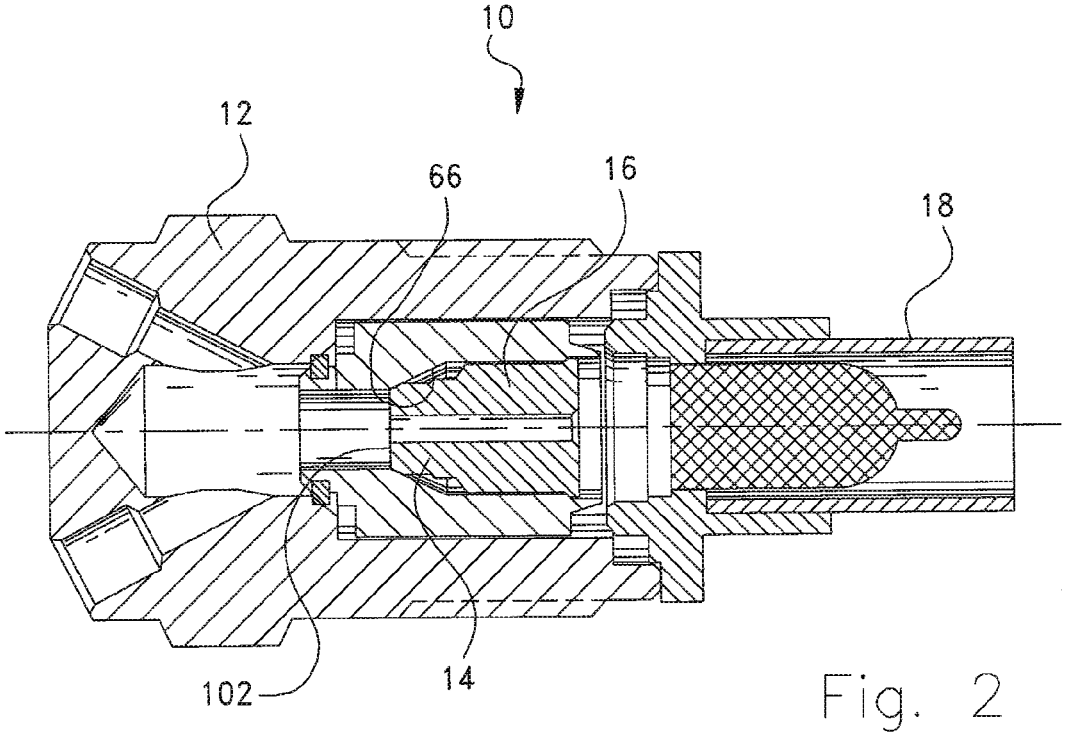
FIG. 2 is a sectional view showing the orifice piston expansion device of FIG. 1 in an assembled condition (without the fastening member), with the movable piston being positioned in the metering direction.
Figure 3:
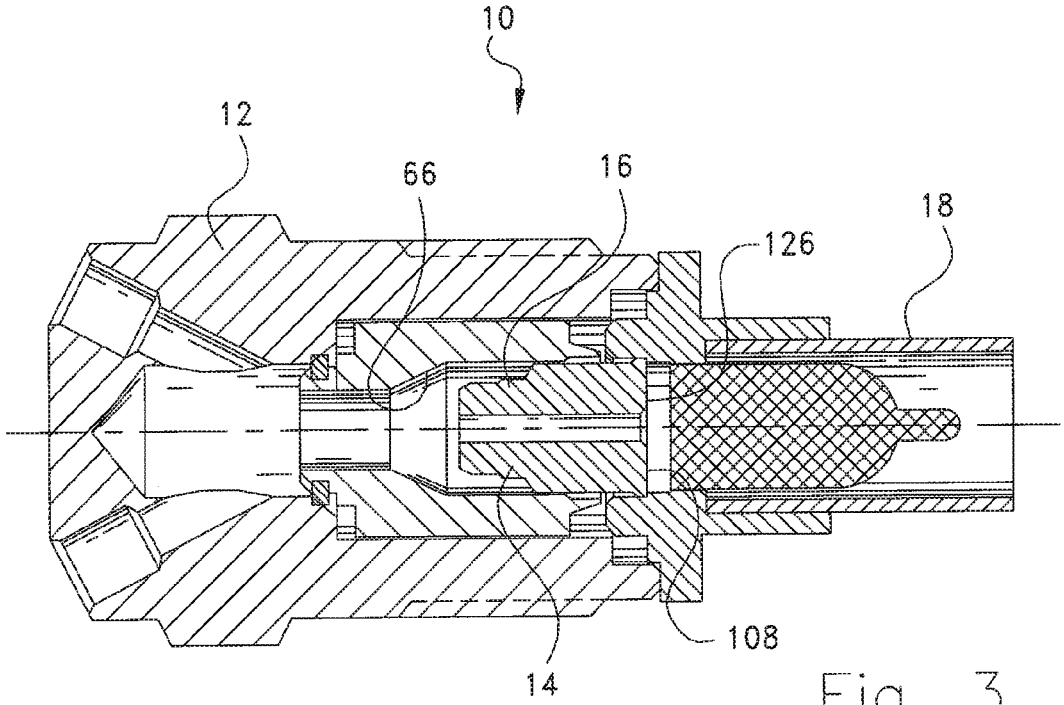
FIG. 3 is a sectional view, similar to that of FIG. 2, but with the movable piston being positioned in the free-flow direction.

Adaptor flange end 118 includes a further inner peripheral cylindrical surface 128 of a diameter slightly greater than that of the maximum outside diameter of piston 16 so as to permit free axial sliding movement of piston rear end portion 106 toward and away from screen end face 126. In addition, flange end 118 also includes a cylindrical portion 130, adapted to mate with an interior surface 58 of housing end face 54, while a flange end annular end face 132 is adapted to abut housing annular end face 54, upon the assembly of adaptor 18 to housing 12, as best seen in FIGS. 2 and 3. An inner annular end face 136 can function as a rear abutment surface that limits any axial movement of restrictor insert 14, in one direction, within housing chamber 50, as will be detailed later.

In terms of the assembly of orifice expansion device 10, as best seen in FIG. 1, restrictor insert 14 is adapted to be axially inserted into housing chamber 50 until restrictor insert leading frusto-conical front end surface 84, together with seal member 96, makes physical contact with housing frusto-conical valve seat 46. Then, restrictor or piston 16 is inserted into a central bore cavity 70, defined by piston bore portions 64, 66 and 68, until there is physical contact between bore portion 66 and restrictor front end radius portion 105. Thereafter, adaptor flange end 118, specifically cylindrical portion 130 thereof, is mated with housing interior surface 58 until there is physical contact, in the manner already described, in terms of abutment between housing end face step portion 56 and adaptor flange annular end face 132, whereupon nut 28 is threaded upon housing cavity end 28, thereby completing the mechanical assembly of orifice expansion device 10.

In terms of the operation of device 10, restrictive insert 14, when installed as described, has only limited axial movement capabilities within housing cavity 50, but piston 16 is capable of cycling, within insert 14, depending upon the direction of flow of the refrigerant medium, so as to alternately perform the required metering and bypass functions which are well known in the art. Specifically, piston 16, which is shown in FIG. 2 as being positioned in the metering direction, wherein its front end portion 102 abuts restrictor insert joinder bore portion 66, permits refrigerant medium flow from right to left, via through bore 100 only, in a metering function or operational phase. Thus, piston 16, which is moved fully to the left, within insert 14, provides a metering function in one axial direction.

When the refrigerant medium flows from left to right, piston 16 is displaced, within restrictor insert 14, to the right, until its end portion 108 abuts screen end face 126, as illustrated in FIG. 3, thus establishing free-flow since the refrigerant medium not only flows via piston through bore 100, but also around and over the outer periphery of piston 16 and through the axial flutes, if so provided, in a manner well known in the art. Thus, at this time, it should be well understood that, while retention insert 14 may have but limited axial movement within housing 12, piston 16, is able to axially cycle freely within insert 14 to perform the noted metering and bypass functions. Insert 14 can be comprised of any refrigerant medium-compatible material and preferably consists of a brass alloy, if machined, or a nylon material, if molded.

The utilization of a separate, distinct, restrictor insert 14 allows independent coil manufacturers and installers to use any of the known types of restrictors or pistons 16 in the same or a common flow control distributor housing 12. Thus, for example, the three-fluted or five-fluted pistons, set forth in U.S. Pat. No. 5,894,741 to Durham et al., as well as the "bullet-nose" pistons, set forth in U.S. Pat. No. 4,896,696 to Bradley et al., can be used interchangeably. While restrictor insert 16 is illustrated as having a predetermined, specific axial extent, this can be adjusted, e.g., decreased if needed, so as to function successfully in other flow control housings. Therefore, while in the past, flow control distributor housings 12 were specifically designed and manufactured to accommodate but one style of piston 16, the present invention promotes ready interchangeability thus not only increasing choices, decreasing required part proliferation, inventories and costs, but also permitting a convenient, cost-effective, way of replacing or substituting pistons 16, if so desired. In the prior art structures the entire orifice expansion device had to be replaced.

It is deemed that one of ordinary skill in the art will readily recognize that the present invention fills remaining needs in this art and will be able to affect various changes, substitutions of equivalents and various other aspects of the invention as described herein. Thus, it is intended that the protection granted hereon be limited only by the scope of the appended claims and their equivalents.

What is claimed is:

1. An orifice expansion device for bi-directionally flowing pressurized fluid, said device comprising in combination:

a. a generally cylindrical flow control distributor housing having a forward distributor end with a nozzle face and at least one port and an associated duct, said housing also having a threaded rearward coupling end, having an annular outer stepped portion, and a central axial cylindrical fluid passageway extending from a forward passageway end, that is in communication with said at least one port, to an open rear passageway, via an intermediate, annular, frusto-conical valve seat;

b. a generally cylindrical restrictor insert with a central axial through bore having a cylindrical first bore portion, coupled to a cylindrical second bore portion via an annular frusto-conical joinder bore portion, and a cylindrical third bore portion, with said bores defining a central bore cavity, said restrictor insert also having a cylindrical outer surface, having an outter leading portion with multiple steps and a leading frusto-conical front end surface, separated from said multiple steps via an intermediate peripheral groove, said restrictor insert further including a trailing portion having a shoulder portion and an annular end surface, said restrictor insert being adapted for slip insertion into said housing central fluid passageway;

c. a generally cylindrical restrictive member, with an axial through bore, includes an annular front end portion having a frusto-conical front end surface with an adjoining outer radius, said front end portion merging into an annular rear end portion, said restrictive member being adapted for insertion into, and free axial reciprocal movement within, said restrictor insert central bore cavity;

d. a generally annular adaptor having a leading flange end and a trailing tubular end configured for connection with said pressurized fluid, said adaptor also including, attached at a flange end inner cylindrical surface, a flange end of a filter member, said adaptor leading flange sealingly abutting at least said shoulder portion of said restrictor insert trailing portion; and e. a threaded fastening member surrounding said adaptor leading flange and adapted for threaded engagement with said distributor housing rearward coupling end.

2. The orifice expansion device of claim 1, further including an annular seal member, said seal member inside diameter being seated in said restrictor insert intermediate peripheral groove, said seal member, together with said leading frusto-conical front end surface of said restrictor insert being in sealing contact with said distributor housing frusto-conical valve seat at least when said pressurized fluid is flowing in one direction.

3. The orifice expansion device of claim 1, wherein the axial extent of said restrictor insert is slightly less than that of said distributor housing rear passageway, thus permitting limited axial movement of said restrictor insert within said rear passageway.

4. The orifice expansion device of claim 1, wherein the axial extent of said restrictive member is less than that of said central bore cavity of said restrictive insert, thus permitting axial movement of said restrictive member within said central bore cavity.

5. The orifice expansion device of claim 4, wherein, when said pressurized fluid is flowing in one axial direction, said outer radius of said restrictive member frusto-conical front end portion makes sealing contact with said frusto-conical joinder bore portion of said restrictor insert, thus permitting metered flow of said pressurized fluid only through said restrictive member axial through bore.

6. The orifice expansion device of claim 5, wherein, when said pressurized fluid is flowing in an opposite axial direction, said annular end portion of said restrictive member makes physical contact with said flange end of said adaptor filter member, thus permitting bypass flow of said pressurized fluid both through said restrictive member axial through bore and around the peripheral surface of said restrictive member.

7. The orifice expansion device of claim 1, wherein said restrictor insert cylindrical first bore portion has a predetermined first diameter, said second bore portion has a predetermined second diameter portion and said third bore portion has a predetermined third diameter, said diameters being of respective progressively larger diametral extent.

8. The orifice expansion device of claim 7, wherein the peripheral outer surface of said cylindrical restrictive member is substantially cylindrical.

9. The orifice expansion device of claim 7, wherein the peripheral outer surface of said cylindrical expansion device is provided with a plurality of peripherally spaced axial flutes.

10. In an orifice expansion device for bidirectionally movable pressurized fluid, including:

a. a generally cylindrical flow control distributor housing having an apertured forward distributor end and an integral open-ended threaded rearward coupling end with an end face, said housing further including an frusto-conical valve seat intermediate a central axial fluid passageway and said end face;

b. a generally cylindrical restrictive member, with an axial through bore, including a frusto-conical front end surface, with an adjoining outer radius, and an integral annular rear portion;

c. a generally annular adaptor having a leading flange end and a trailing tubular end, including an internal filter member within said adaptor; and d. a threaded fastening member surrounding said adaptor and adapted for threaded engagement with said distributor housing coupling end, wherein the improvement comprises:

e. the addition of a generally cylindrical restrictor insert, having a central axial through bore, said restrictor insert having a plurality of successively joined bore portions defining a central bore cavity, said restrictor insert also having an outter leading portion, with multiple steps and a leading frusto-conical front end surface, seperated from said multiple steps via an intermediate peripheral groove, an intermediate portion and a trailing portion, the latter having a shoulder portion and an annular end face, said restrictive member being located and axially freely movable within said restrictor insert central bore cavity, with said restrictor insert, in turn, being located, after slip-fit insertion, in said distributor housing central fluid passageway.

11. The improved orifice expansion device of claim 10, further including, in said restrictor insert leading portion, and an annular seal, with said seal inside diameter being located within said groove, said seal together with said restrictor insert frusto-conical front end surface being in sealing contact with said distributor housing frusto-conical valve seat, at least when said pressurized fluid is flowing in one direction.

12. The improved orifice expansion device of claim 10, wherein the axial extent of said intermediate portion of said restrictor insert can be varied in order to fit within the axial extent of said distributor housing central axial fluid passageway.

13. The improved orifice expansion device of claim 10, wherein the axial extent of said restrictor insert is shorter than that of said distributor housing rear passageway, thus permitting limited axial movement of said restrictor insert within said rear passageway.

14. The improved orifice expansion device of claim 11, wherein the axial extent of said restrictive member is substantially shorter than that of said restrictive insert central bore cavity, thus permitting substantial axial movement of said restrictive member within said central bore cavity.

15. The improved orifice expansion device of claim 14, wherein, when said pressurized fluid is flowing in one axial direction, said outer radius of said restrictive member frusto-conical front end portion is in abutting sealing contact with a frusto-conical joinder bore portion of said restrictor insert, thus permitting only metered flow of said pressurized fluid through said restrictive member axial through bore.

16. The improved orifice expansion device of claim 15, wherein, when said pressurized fluid is flowing in an opposite axial direction, said annular end portion of said restrictive member is in abutting contact with a flange end of said adaptor filter member, thus permitting both metered flow through said restrictive member axial bore and bypass flow around the peripheral surface of said restrictive member.

17. A generally cylindrical restrictor insert, for housing therein a freely axially movable, centrally apertured, cylindrical restrictive member, said restrictor insert, in turn, being housed within the central passageway of a flow control distributor housing of an orifice expansion device used for conducting bi-directionally flowing pressurized fluid, said passageway being closed off, on one end, via a leading flange end of an annular adaptor also having an internal filter member, said restrictor insert having a central axial through bore with a cylindrical first bore portion, coupled to a cylindrical second bore portion via an annular frusto-conical joinder bore portion, and a cylindrical third bore portion, with said bores, together defining a central bore cavity, said restrictor insert also having an outter leading portion with multiple steps and a leading frusto-conical front end surface, separated from said multiple steps via an intermediate peripheral groove, an intermediate portion and a trailing portion, said restrictor insert being slip-insert fitted into said housing central fluid passageway.

18. The restrictor insert of claim 17, further including, an annular seal member, with an inside diameter thereof being retained within said peripheral groove, said seal member, together with said leading frusto-conical front end surface of said restrictor insert being in abutting, sealing, contact with a frusto-conical valve seat within said distributor housing, at least when pressurized fluid is flowing in one direction.

19. The restrictor insert of claim 18, wherein the axial extent of said restrictor insert is similar to that of said distributor housing central passageway, thus permitting only limited axial movement of said restrictor insert therein.

20. The restrictor insert of claim 18, wherein the axial extent of said intermediate portion of said restrictor insert is adjusted to fit within the axial extent of an existing distributor housing central passageway.

* * * * *